United States Patent [19]

Young

[11] 3,932,897

[45] Jan. 20, 1976

[54] HOCKEY GARTER BELT

[75] Inventor: Nathan H. Young, Boynton Beach, Fla.

[73] Assignee: Baka Manufacturing Co., Inc., Plainville, Mass.

[22] Filed: Dec. 12, 1974

[21] Appl. No.: 531,922

[52] U.S. Cl. ..... 2/306; A41F/19/00

[58] Field of Search ..... 2/300–306, 2/311–314, 323

[56] References Cited

UNITED STATES PATENTS

| | | | |
|---|---|---|---|
| 675,748 | 6/1901 | Magoris | 2/304 |
| 1,551,358 | 8/1925 | Anderson | 2/306 X |
| 2,530,850 | 11/1950 | Atchley | 2/306 |
| 2,579,190 | 12/1951 | Kaldor | 2/306 |
| 2,975,432 | 3/1961 | Johnson | 2/306 |
| 3,374,636 | 3/1968 | Mason | 2/312 X |

*Primary Examiner*—Geo. V. Larkin

*Attorney, Agent, or Firm*—Wolf, Greenfield & Sacks

[57] ABSTRACT

A hockey garter belt includes an elongate body encircling member formed from three sections connected end-to-end in which the intermediate section is elasticized so that the belt may be stretched in a body encircling direction. The opposite ends of the belt may be fastened by cooperation of a looped fabric at one end of the belt with hook members fastened to the other end of the belt. A plurality of garter straps are attached to the belt at selected locations to reinforce the belt.

3 Claims, 3 Drawing Figures

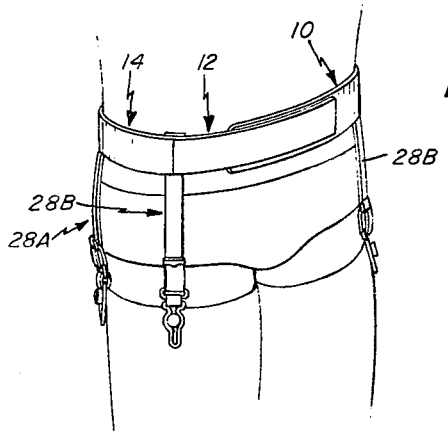
FIG. 1
FIG. 2
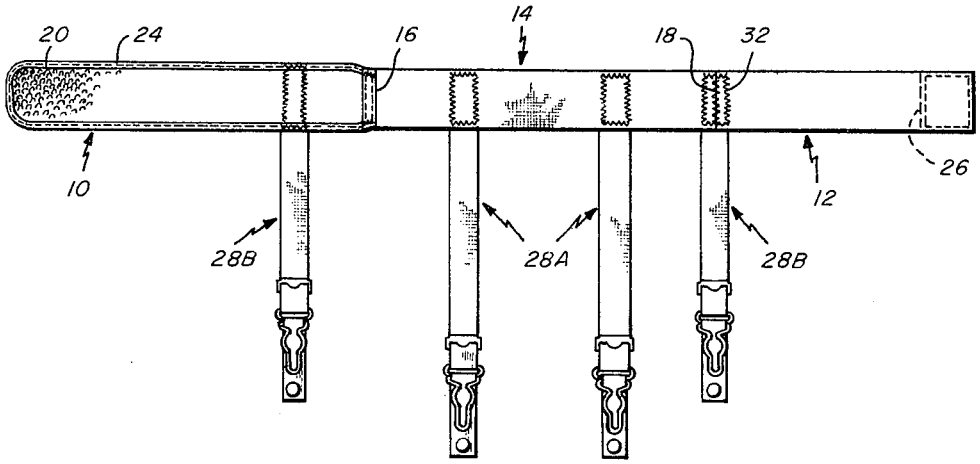
FIG. 3
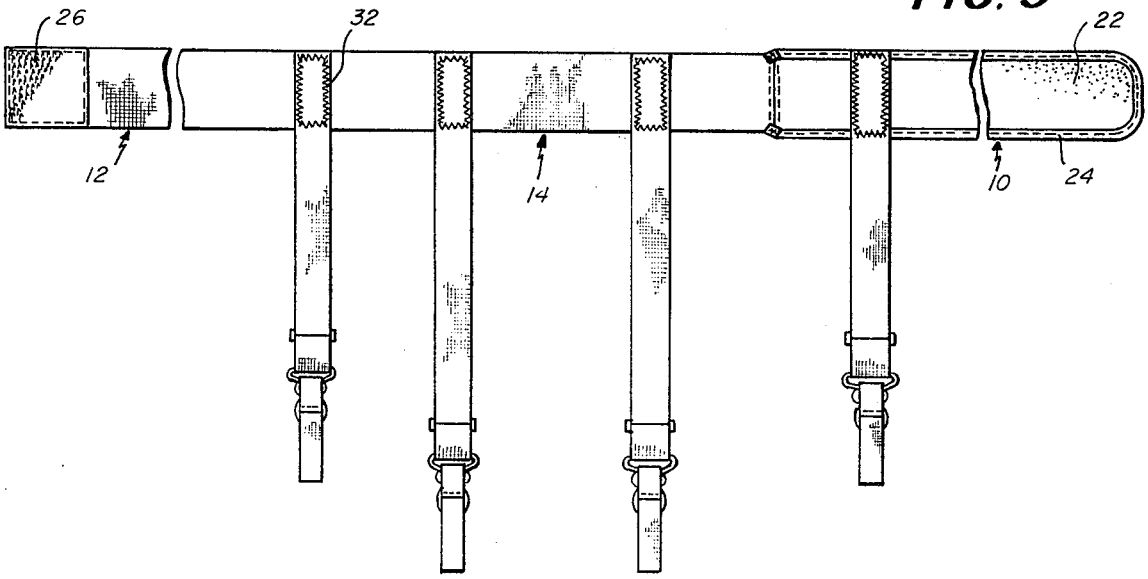

HOCKEY GARTER BELT

BACKGROUND AND SUMMARY OF THE INVENTION

The present invention relates to improved garter belts which are adapted particularly for use as part of a hockey uniform to support relatively heavy stockings which typically are worn as part of a hockey uniform. The invention provides a number of advantages and is an improvement over prior hockey garter belts in that it employs an improved reinforcing arrangement, is of significantly less expensive construction than prior hockey garter belts and is usable over a wide range of sizes.

In brief, the belt is formed from three sections connected end-to-end in which the end sections are non-stretchable while the intermediate section is made from an elasticized, stretchable material. One of the end sections is formed from an inexpensive non-stretchable fabric having a surface which defines a multiplicity of looped fibers. A fastening element which includes a multiplicity of resilient hook members is secured to the opposite end of the belt to engage and be locked to the looped fabric when the device is worn. A plurality of garter straps are attached to the belt at spaced locations thereon and at least some of the garter straps are secured in a manner to overlap the juncture between the intermediate section and one or both of the end sections to enhance the strength at the juncture.

The invention will be understood more fully from the following further description of an embodiment thereof, reference to the accompanying drawings in which:

DESCRIPTION OF THE DRAWINGS

FIG. 1 is an illustration suggesting the manner in which the hockey belt is worn about the torso;

FIG. 2 is a plan illustration of the belt as seen from the outside surface; and

FIG. 3 is a plan illustration of the belt as seen from the inside surface.

DESCRIPTION OF THE PREFERRED EMBODIMENT

The belt is intended to be worn as suggested in FIG. 1 by wrapping it about the waist. The belt includes a pair of end sections 10, 12 which are non-stretchable and an intermediate section 14 which is made from an elasticized webbing and which is stretchable along its length and in a body encircling direction. The end sections 10, 12 are secured to the opposite ends of the intermediate section 14 as by overlapping them and stitching as shown at 16, 18. The end section 10 which preferably is at least one third the overall unstretched length of the belt is made from a looped fabric which may be of woven cotton having the loops extending from the outwardly facing surface 20 of the belt. The fabric for the end section 10 is inexpensive and is non-stretchable. End section 10 preferably also has a soft liner 22 on the opposite, inside surface. The peripheral edge of the end section may be bound by a strip of cloth 24 as shown.

The outer end of the other end section 12 is provided with a strip of fastener material 26 for example, of the type marketed under the trademark Velcro which includes a multiplicity of closely spaced outwardly protruding hook-like fasteners such as those described in U.S. Pat. No. 2,933,797. The hooks may be made of nylon or other suitable material which enables them to hold their shape and remain in an upstanding configuration to face away from the surface of the section 12. When the belt is worn, the hooks will face inwardly and can be easily pressed into firm locking engagement with the loops on the outwardly facing surface of the section 10. The width of the fastener material 26 is substantially equal to the width of the exposed looped material.

The belt includes a plurality of garter straps 28 each of which is secured at its upper end to the belt with the straps being spaced along the belt. A stocking fastener 30 is secured to the lower free end of each of the garter straps. Typically, the garter belt will employ four such straps, two for use with each stocking. In the preferred embodiment, the two inside garter straps 28A are longer than the outside garter straps 28B. When worn as suggested in FIG. 1, the inside straps will be disposed adjacent the back of the wearer's leg and the outside straps will be disposed nearer to the front of his leg. By employing longer garter straps 28A to attach to the stocking along the backside of the leg, the garter strap 28A can stretch more readily and does not restrict the wearer's movement as might be the case if the rearward straps 28 were relatively short as the same length as straps 28B. In this regard, it may be noted that hockey players often assume a crouched position in which there is more of a tendency to stretch the rearwardly disposed garter straps 28A.

It also is preferred to secure the garter straps 28 to the body encircling member in a manner which reinforces one or both of the stitchings 16, 18, where the end sections 10, 12 are joined to the intermediate section 14. Thus, as shown, one or more of the garter straps 28 may be located to span the juncture of the intermediate section with an end section and may be stitched as by the rectangular stitching pattern 32 both to stitch the garter strap 28 to the body encircling member as well as to provide additional reinforcement for the overlapping stitched region where the end section 12 and intermediate section 14 are joined. In addition, it is preferred to stitch the garter straps to the inside surface of the body encircling member, particularly when it is desired to secure one of the garter straps 28 to the end section 10 which includes the looped fabric. By fastening the garter strap 28 to the inside surface of end section 12 the outwardly facing loops 20 are not interfered with and the fastener material 26 may be secured to the loops even over the region where the garter strap 28 is stitched to the end section 10.

It will be appreciated that the foregoing arrangement results in a hockey garter belt which can be used over a wide range of sizes. This results from the fact that in addition to the stretchable feature of the elasticized intermediate section 14, the end section 12 on which is formed the looped fastening elements 20 extends over a very substantial portion of the length of the body encircling member, at least one third of its length and, perhaps as much as half of the length. In addition, by employing the relatively inexpensive looped fabric for a substantial portion of the belt, the cost of the belt is reduced significantly.

It should be understood that the foregoing description of the invention is intended merely to be illustrative thereof and that other embodiments and modifications may be apparent to those skilled in the art without departing from its spirit.

Having thus described the invention, what is claimed is:

1. A hockey garter belt comprising:

a body encircling member having first and second elongate end sections and intermediate elongate section, the end sections being connected to opposite ends of the intermediate section;

the first of the end sections being formed from a nonstretchable web of material;

the second of the end sections being formed from a nonstretchable web of material and having one surface thereof substantially completely covered by and defining a looped fabric, the looped fabric extending along at least one third of the overall length of the body encircling member;

the intermediate section being formed from an elastic webbing which is stretchable in its longitudinal direction;

a plurality of elongate garter straps each formed from a length of the body encircling sections having at least one garter strap attached thereto at the inside surface thereof, each garter strap having means at the free end thereof for attaching a portion of a stocking thereto, at least two of the garter straps being attached to the elastic intermediate section;

the inwardly facing surface of the second end member being of a relatively soft fabric; and a strip of fastener material secured to the free end of the first end section and on the opposite side of the body encircling member from that on which said looped fabric is disposed, the fastener material including a multiplicity of closely spaced hooked mem-ers to releasably lock with the looped fabric at any location along the looped fabric.

2. A device as defined in claim 1 where at least one of the garter straps is secured to the body encircling member at the juncture of an end section and the intermediate section.

3. A hockey garter belt as defined in claim 1 wherein each of the outermost of the garter straps is connected to its associated end section.

* * * * *